US006892041B1

(12) United States Patent
Shehata et al.

(10) Patent No.: US 6,892,041 B1
(45) Date of Patent: May 10, 2005

(54) PASSIVE DIRT SHIELD FOR IMAGE REPRODUCTION DEVICES

(75) Inventors: Ahmed-Moshen T. Shehata, Penfield, NY (US); Robert B. Anderson, Jr., Syracuse, NY (US); Timothy Patrick Foley, Marion, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/635,738

(22) Filed: Aug. 6, 2003

(51) Int. Cl.[7] ..... G03G 15/00
(52) U.S. Cl. ..... 399/98
(58) Field of Search ..... 399/98, 73, 74

(56) References Cited

U.S. PATENT DOCUMENTS 6,272,295 B1 8/2001 Lindblad et al.

FOREIGN PATENT DOCUMENTS

| | | | | |
|---|---|---|---|---|
| JP | 54156547 A | * | 12/1979 | ..... G03G/21/00 |
| JP | 63103064 A | * | 1/1988 | ..... G03G/15/02 |
| JP | 2000056643 A | * | 2/2000 | ..... G03G/21/00 |
| JP | 2001083748 A | * | 3/2001 | ..... G03G/15/00 |

* cited by examiner

*Primary Examiner*—Quana Grainger
(74) *Attorney, Agent, or Firm*—Gregory P. Gadson

(57) ABSTRACT

A system for shielding sensors from airborne particulate matter in the environment of an electrostatic image reproduction device at least includes: a moving surface; at least one sensor; and a shield having at least one shield window, the shield adapted to be placed between the moving surface and the sensor, and the shield at least partially encloses a subsystem of the image reproduction device; wherein the movement of the surface, and the shield and the shield window cooperate to move air through the shield window past the sensor toward the moving surface.

20 Claims, 5 Drawing Sheets

PASSIVE DIRT SHIELD FOR IMAGE REPRODUCTION DEVICES

FIELD OF THE INVENTION

The present invention relates to maintaining clear optical lenses on electrostatic image reproduction process control sensors.

BACKGROUND OF RELATED ART

The general xerographic printing process used by printers, copiers and the like utilizes several well-known steps for making and transferring a latent image to a paper of other "substrate" material. A high voltage corotron wire emits charged particles via a coronal discharge process to uniformly charge the surface of a moving photoreceptor ("PR" or P/R") having photoconductor qualities. The PR is often a circulating belt, but may also take the form of a rotating drum, for example. A metal grid and other electronic components typically regulate the PR charging levels.

When a section of the PR needing to receive a latent image advances to an exposure station, a copy of the image to be reproduced is sent to a laser. As will be described later, toner is used on the paper to represent the image pels or pixels. The laser is scanned over the PR in a raster-like manner exposing all locations of the PR where toner is desired (or alternatively, not exposing all locations on the PR where toner is desired using a negative convention). The light from the laser is thus modulated to correspond to the image to be copied, and the exposed areas of the PR discharge in the process. Consequently a latent image representing the image to be copied appears on the PR in the form of the pattern of charges on the PR surface.

In the developing step, toner particles are pre-charged and then loosely transferred to the discharged areas of the latent image on the PR to form a toner image. After the developing step, process control sensors such as toner area coverage (TAC) or extended toner area coverage (ETAC) sensors monitor the proportion of the area of the PR covered by toner to aid in image quality control. ETAC sensors, for example, can be used to optically measure the development control patch image characteristics. Other process control sensors that may be used include marks on belt (MOB) sensors that assure the exact placement of one color on top of another on an intermediate belt for proper color-to-color registration in a color image reproduction process.

In the transfer step, the paper to receive the image or an intermediate medium if applicable is pre-charged to a high level relative to the PR. The toner is then electrostatically transferred to the paper or medium from the PR to match the image to be copied.

In the cleaning step, residual toner particles are cleaned from the PR so that region is available to receive a new image without contaminating residue from an old image.

The last major step prior to outputting the paper is fusing the toner to the paper fibers under high temperature and pressure for a permanent finish.

Because of the airborne nature of small toner particles, many components of the reproduction device can become impermissibly coated or soiled over time. The components can include the various process control sensors, eventually causing them to operate out of the prescribed range and affect copy quality, requiring a service call to either clean or replace the sensors. In fact, many prior art electrostatic reproduction devices require such service calls after approximately fourteen thousand copies have been made.

One prior art approach exemplified by U.S. Pat. No. 5,809,375 issued to Alvin J. Owens et al. and also assigned to the assignee of the present application, is to filter the air inside of the device with a blower to circulate the air, and use one or more manifolds for filtering airborne toner and other particulate matter. While this may be successful in removing much of the airborne toner prior to the air exiting a customer replaceable unit (CRU), airborne toner and other particulate can still reach the process control sensors, whether directly or indirectly from the toner source from leaks in the filtering path and other causes. This may still lead to undesirable service intervals due to dirty sensor lenses. Further, adequate filtering using the blower and filter approach may not be adequate for keeping process control sensors clean at a cost necessary for low-end electrostatic image reproduction devices.

There is a great need to provide a mechanism for greatly extending the service intervals (for example, one million prints between service calls) for electrostatic reproduction devices related to process control sensor optical degradation. To that end, there is also a need to provide for the substantial reduction of toner and other particles and particulate matter around the lenses of process control sensors without introducing complex electromechanical components.

SUMMARY

In view of the above-identified problems and limitations of the prior art, the present invention provides a system for shielding sensors from airborne particulate matter in the environment of an electrostatic image reproduction device. The system at least includes a moving surface, at least one sensor, and a shield having at least one shield window, the shield adapted to be placed between the moving surface and the sensor, and the shield at least partially encloses a subsystem of the image reproduction device. The movement of the surface, and the shield and the shield window cooperate to move air through the shield window past the sensor toward the moving surface.

The present invention also provides a method for shielding sensors from airborne particulate matter in the environment of an electrostatic image reproduction device. The method at least includes providing a moving surface, providing at least one sensor, placing a shield having at least one shield window between the moving surface and the sensor, via the shield, at least partially enclosing a subsystem of the image reproduction device, and via the movement of the surface, and the shield and the shield window, moving air through the shield window past the sensor toward the moving surface.

The process control sensors can be located near the process control sensor windows or directly coupled to the shield at the process control sensor windows.

The present invention is not limited to use with photoreceptors as the moving or rotating surface used to develop the low pressure region discussed infra. Such surfaces include, but are not limited to, ROS imagers, charge lamps, ATAs, stripper bars, and fuser rollers. Likewise, the sensors need not be optical sensors, nor must they strictly speaking, be process control sensors. In addition to the examples of ETACs, MOBs, and TACs given below, the sensors can include many more types, such as paper path sensors.

BRIEF DESCRIPTION OF THE DRAWINGS

Features of the present invention will become apparent to those skilled in the art from the following description with reference to the drawings, in which.

DETAILED DESCRIPTION

Figure 1:
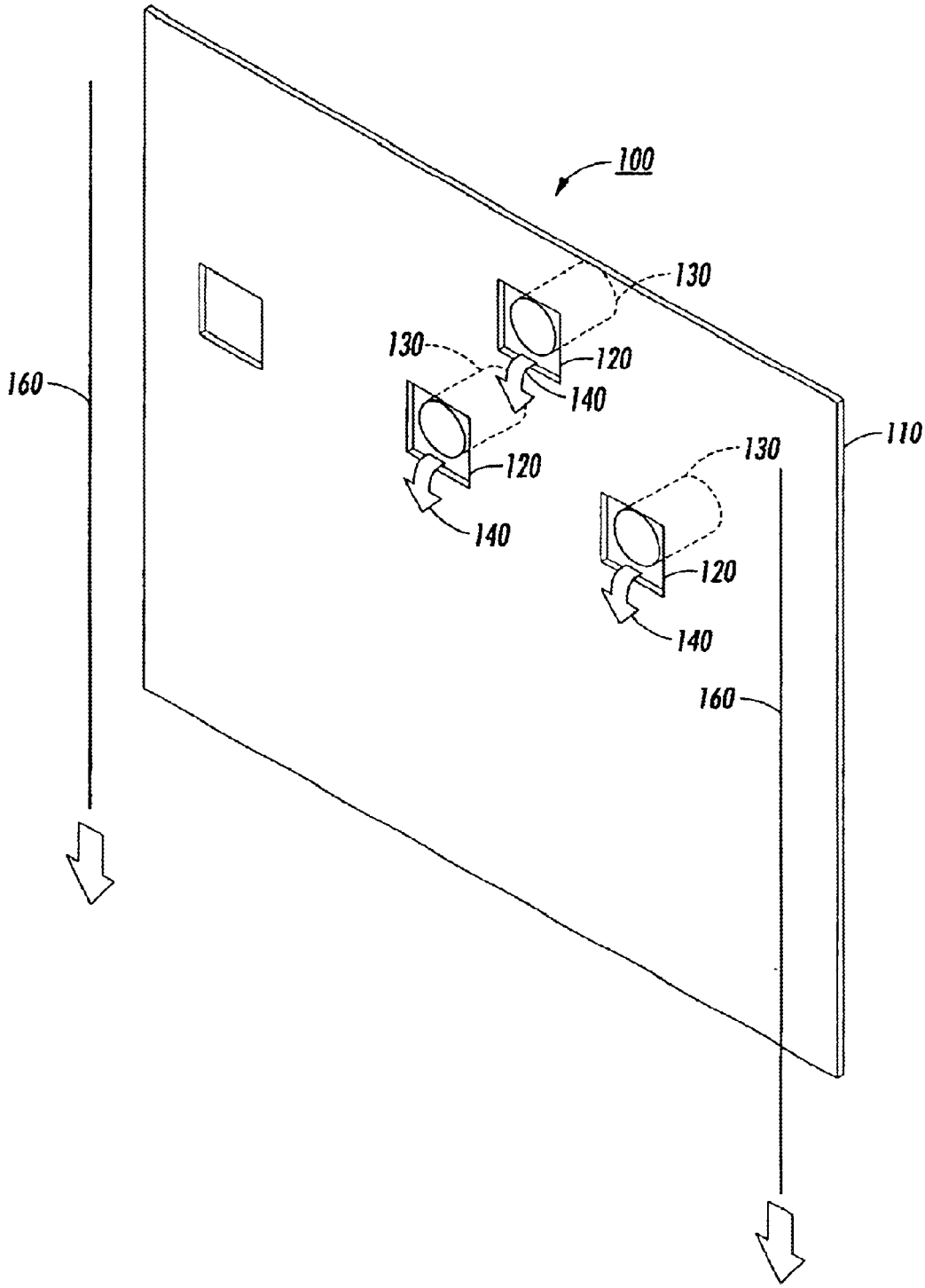
FIG. 1 is a perspective front view of the present-inventive dirt shield implementation for moving clean air past process control sensors.

Several views of the novel dirt/particulate shielding system 100 are shown in the drawing figures. The system 100 functions within the environs of an electrostatic image reproduction device such as a copier or printer.

Figure 5:
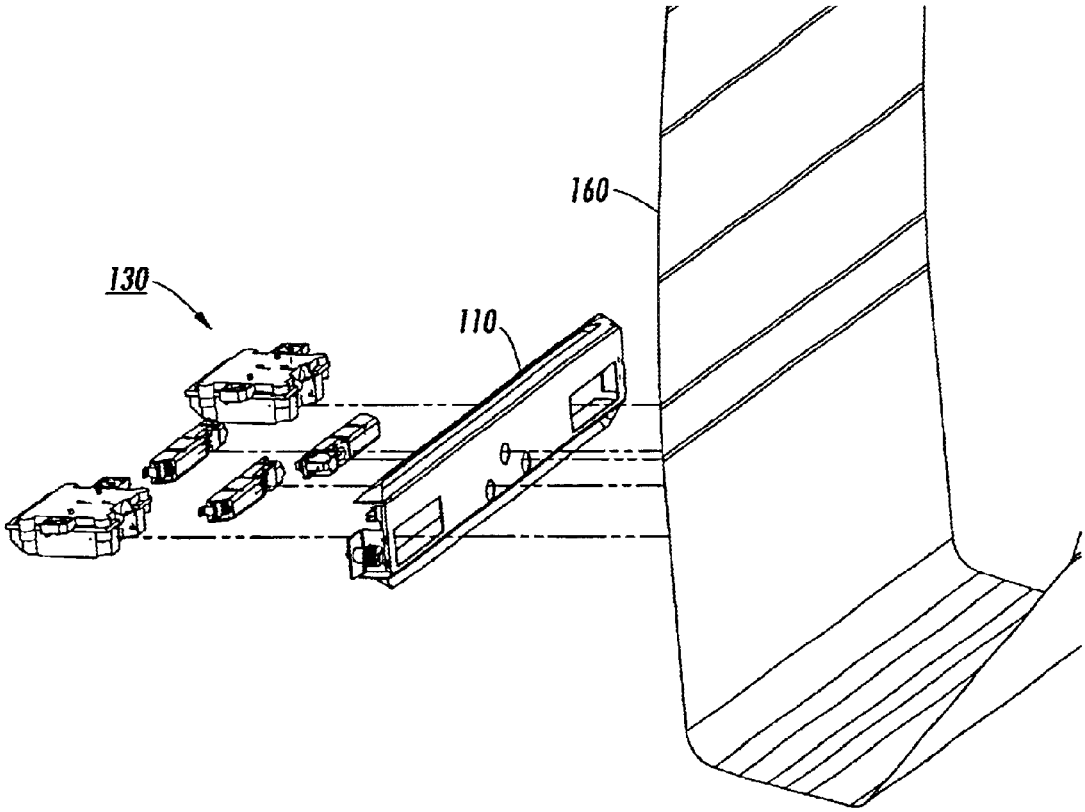
FIG. 5 is a perspective side view of the present-inventive dirt shield implementation for moving clean air past process control sensors.

Turn to FIGS. 1 and 5, a passive dirt shield or shield 110 is placed between process control sensors 130 needing shielding, and a photoreceptor (PR) belt 160. The PR 160 is shown as transparent in FIG. 1 for convenience only. The process control sensors include, extended toner area coverage (ETAC) sensors, and marks on belt (MOB) sensors. Given the description of the present invention, however, it will be apparent to those skilled in the art to which the present invention pertains that other process control sensors can be shielded, such as toner area coverage (TAC) sensors. In fact, the sensors need not be optical sensors, nor must they strictly speaking, be process control sensors. A further example of sensors which would benefit from the present invention is paper path sensors.

Figure 2:
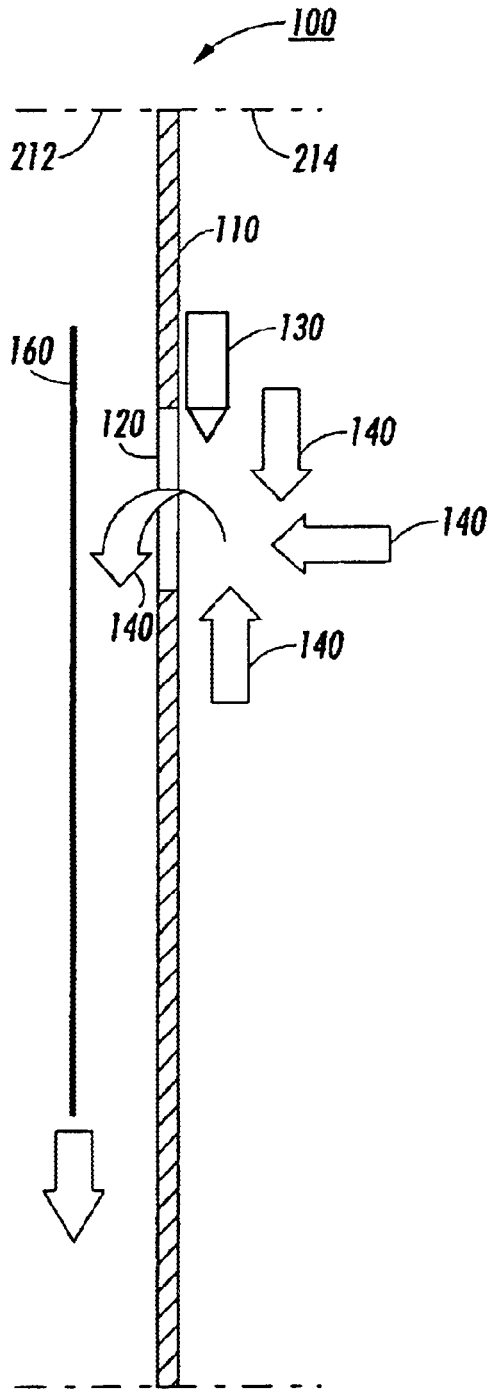
FIG. 2 is a side view of the present-inventive dirt shield implementation for moving clean air past process control sensors.

The shield 110 can be made to extend and at least substantially enclose a subsystem of the reproduction device. Therefore, the shield 110 can extend in a direction to include the PR with portions 212 and 214 (as shown in FIG. 2). Or, the shield 110 can extend in a direction to include the process control sensors 130 and other components with portions such as 216 and 218 (as shown in FIG. 2).

The process control sensors 130 are able to view the PR 160 through process control sensor windows or view holes (also known as shield windows) 120 and provide feedback for the process control of the reproduction device. The process control sensors can be located near the process control sensor windows or directly coupled to the shield at the process control sensor windows, as was previously stated in the "Summary" section.

The movement of the PR belt 160 causes a circulation of air and a resulting low pressure near the PR. A pressure differential forms between the low pressure air on the PR side of the shield and the higher pressure air on the process control sensor side of the shield. The air flows from the higher pressure region through the view holes toward the PR belt. A steady flow of cleaner air moves past the process control sensors, and "dirtier" air stays around the PR. Explained differently, residual matter such as toner particles on or around the PR tend to stay in that vicinity. The relatively small size of the view holes 120 contributes to the air flow by causing the airflow to accelerate through the constricted space as it moves past the shield 110 toward the PR 160.

Figure 3:
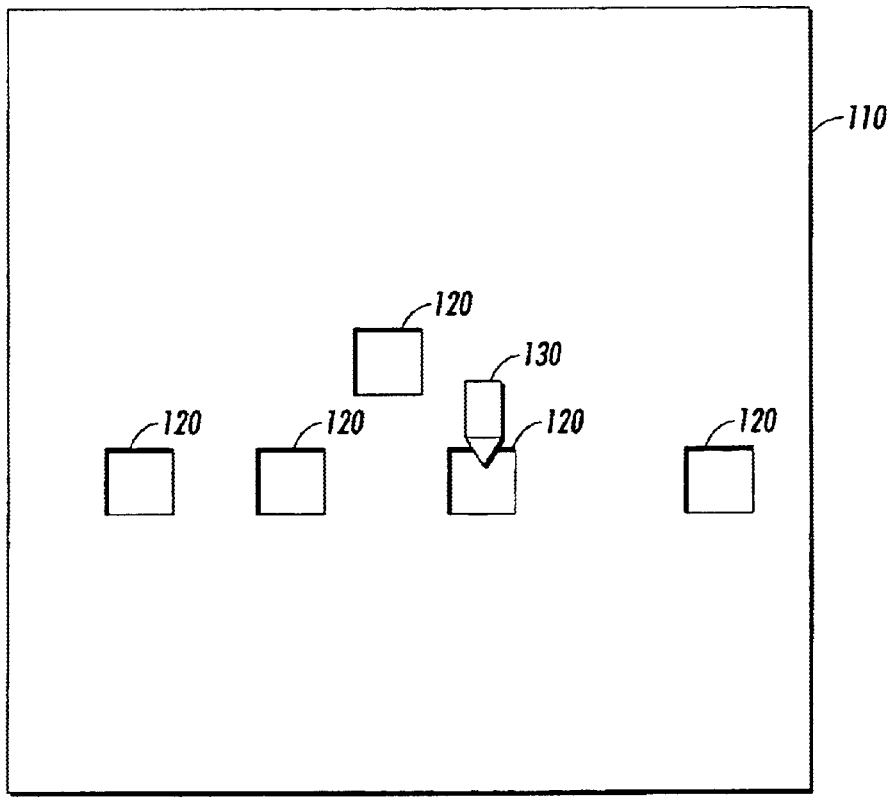
FIG. 3 is a rear view of the present-inventive dirt shield implementation for moving clean air past process control sensors.
Figure 4:
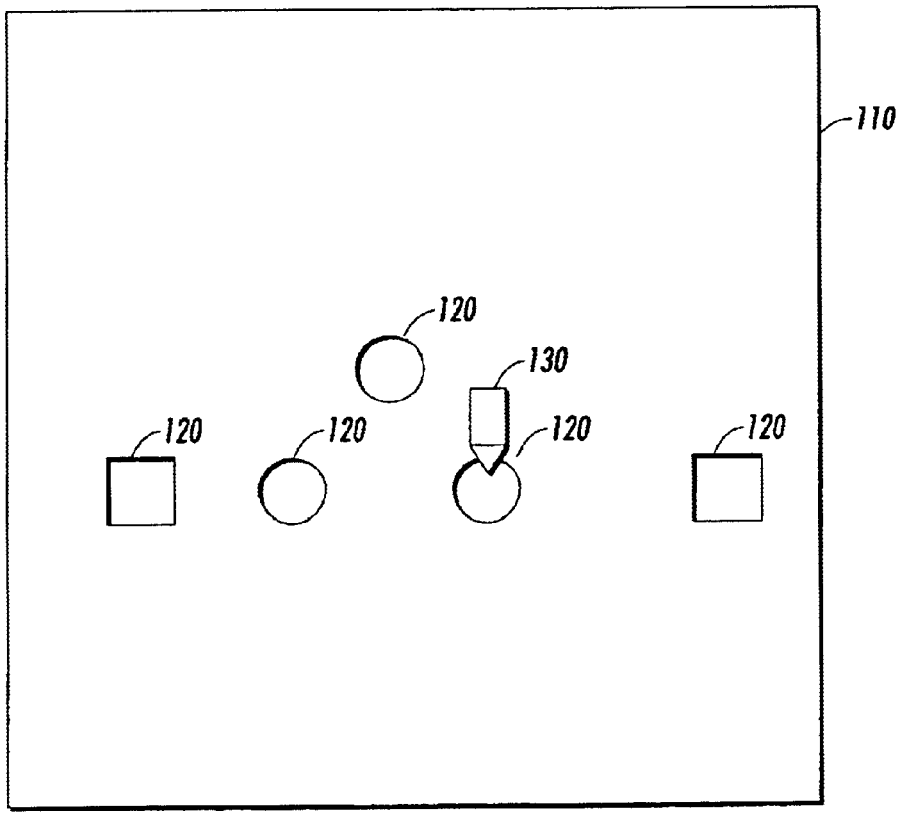
FIG. 4 is an alternate embodiment of the rear view of FIG. 3.

As can be seen, the process control sensor windows 120 may form different shapes in the shield, such as the square shapes featured in FIG. 3 and the circular shapes shown in FIG. 4.

Variations and modifications of the present invention are possible, given the above description. However, all variations and modifications which are obvious to those skilled in the art to which the present invention pertains are considered to be within the scope of the protection granted by this letters Patent.

What is claimed is:

1. A system for shielding sensors from airborne particulate matter in the environment of an electrostatic image reproduction device, said system comprising:

a moving surface;

at least one sensor; and a shield having at least one shield window, said shield adapted to be placed between said moving surface and said sensor, and said shield at least partially encloses a subsystem of said image reproduction device;

wherein the movement of said surface, and said shield and said shield window cooperate to move air through said shield window past said sensor toward said moving surface.

2. The system of claim 1, wherein said sensor is a process control sensor.

3. The system of claim 1, wherein said sensor is an optical sensor having a line-of-sight view of said moving surface through said shield window.

4. A system for shielding sensors from airborne particulate matter in the environment of an electrostatic image reproduction device, said system comprising:

a moving surface;

at least one extended toner area coverage (ETAC) sensor; and a shield having at least one shield window, said shield adapted to be placed between said moving surface and said sensor, and said shield at least partially encloses a subsystem of said image reproduction device;

wherein said sensor has a line-of-sight view of said moving surface through said shield window, and wherein the movement of said surface, and said shield and said shield window cooperate to move air through said shield window past said sensor toward said moving surfaces.

5. The system of claim 3, wherein said sensor is a marks on belt (MOB) sensor.

6. The system of claim 1, wherein said moving surface comprises a photoreceptor (PR) belt.

7. The system of claim 1, wherein said moving surface comprises a photoreceptor (PR) drum.

8. The system of claim 1, wherein said shield window is square shaped.

9. The system of claim 1, wherein said shield window is circular.

10. The system of claim 1, wherein said moving surface comprises a photoreceptor (PR), and said sensor is an optical sensor having a line-of-sight view of said moving surface through said shield window.

11. A method for shielding sensors from airborne particulate matter in the environment of an electrostatic image reproduction device, said method comprising:

providing a moving surface;

providing at least one sensor;

placing a shield having at least one shield window between said moving surface and said sensor;

via said shield, at least partially enclosing a subsystem of said image reproduction device; and via the movement of said surface, and said shield and said shield window, moving air through said shield window past said sensor toward said moving surface.

12. The method of claim 11, wherein said sensor is a process control sensor.

13. The method of claim 11, wherein said sensor is an optical sensor having a line-of-sight view of said moving surface through said shield window.

14. The method of claim 13, wherein said sensor is an extended toner area coverage (ETAC) sensor.

15. The method of claim 13, wherein said sensor is a marks on belt (MOB) sensor.

16. The method of claim 11, wherein said moving surface comprises a photoreceptor (PR) belt.

17. The method of claim 11, wherein said moving surface comprises a photoreceptor (PR) drum.

18. The method of claim 11, wherein said shield window is square shaped.

19. The method of claim 11, wherein said shield window is circular.

20. The method of claim 11, wherein said moving surface comprises a photoreceptor (PR), and said sensor is an optical sensor having a line-of-sight view of said moving surface through said shield window.

* * * * *